US008494191B2

(12) United States Patent
Holst

(10) Patent No.: US 8,494,191 B2
(45) Date of Patent: Jul. 23, 2013

(54) NECKLOOP FOR TELELOOP HEARING AID SYSTEM

(75) Inventor: Kristian Kiehn Holst, Smørum (DK)

(73) Assignee: Oticon A/S, Smorum (DK)

( * ) Notice: Subject to any disclaimer, the term of this patent is extended or adjusted under 35 U.S.C. 154(b) by 598 days.

(21) Appl. No.: 12/707,528

(22) Filed: Feb. 17, 2010

(65) Prior Publication Data

US 2010/0220841 A1 Sep. 2, 2010

(30) Foreign Application Priority Data

Feb. 18, 2009 (EP) ..... 09153088

(51) Int. Cl.
*H04R 5/02* (2006.01)

(52) U.S. Cl.
USPC ..... 381/309; 381/313; 381/315; 381/74; 381/370

(58) Field of Classification Search
USPC ..... 381/315, 92, 309, 313, 74, 370
See application file for complete search history.

(56) References Cited

U.S. PATENT DOCUMENTS

| | | | | |
|---|---|---|---|---|
| 5,793,875 | A * | 8/1998 | Lehr et al. | 381/313 |
| 5,806,346 | A | 9/1998 | Schlinger et al. | |
| 7,257,438 | B2 | 8/2007 | Kinast | |
| 7,371,472 | B2 | 5/2008 | Fukuda | |
| 7,441,917 | B1 * | 10/2008 | Underdown et al. | 362/103 |
| 2006/0039577 | A1 | 2/2006 | Sanguino et al. | |
| 2006/0096070 | A1 | 5/2006 | Ishida | |

FOREIGN PATENT DOCUMENTS

| | | | |
|---|---|---|---|
| DE | 196 28 783 | A1 | 1/1998 |
| WO | WO-03/090321 | A1 | 10/2003 |
| WO | WO-2006/052428 | A2 | 5/2006 |
| WO | WO-2006/105786 | A1 | 10/2006 |

* cited by examiner

*Primary Examiner* — Davetta W Goins
*Assistant Examiner* — Amir Etesam
(74) *Attorney, Agent, or Firm* — Birch, Stewart, Kolasch & Birch, LLP

(57) ABSTRACT

The invention relates to a neckloop for being coupled with a transformer element and for generating an electromagnetic signal for being received by a telecoil of a hearing device or by an induction receiver. In order to avoid strangulation of the person wearing the neckloop the neckloop comprises a teleloop cable having a first end and a second end, and a first magnet and a second magnet for forming a clasp of the neckloop. The first and second magnets are of opposite polarity. The first magnet is provided with a first plating and the second magnet is provided with a second plating. The first plating is in direct contact with the first end and the second plating is in direct contact with the second end.

17 Claims, 11 Drawing Sheets

NECKLOOP FOR TELELOOP HEARING AID SYSTEM

The invention relates to a neckloop for being coupled with a transformer element and for generating an electromagnetic signal for being received by a telecoil of a hearing device or by an induction receiver. The invention further relates to a neckloop system comprising a neckloop and a transformer element coupled to the neckloop. The invention also relates to a hearing device system comprising a neckloop and a transformer element coupled to the neckloop, and further comprising a hearing device having a telecoil or an induction receiver.

A hearing or listening device typically includes a microphone and a telecoil. A microphone is adapted for receiving acoustic sound waves and for converting the received acoustic sound waves to an electrical signal. The hearing or listening device further comprises an amplifier for amplifying the electrical signal and a speaker (termed "receiver") or other output transducer for converting the amplified electrical signal to a signal perceivable as sound, which is output to the user wearing the hearing aid or listening device.

The telecoil is adapted for picking up electromagnetic signals and is typically a small electromagnetic induction coil. Its function is similar to that of an induction receiver and thus only the operations of a telecoil will be described in detail in the following. When the telecoil is arranged within an electromagnetic field it produces a voltage. The electromagnetic field may be generated by an alternating current passing through a teleloop cable worn around the neck of the user of the hearing or listening device or arranged around a room in which the user is. The alternating current represents an audio signal and thus an equivalent audio signal is induced into the telecoil (or the induction receiver) when the telecoil (or induction receiver) is located in the electromagnetic field of the teleloop cable. The signal in the telecoil is then amplified and sent to the speaker of the hearing or listening device.

A typical hearing device system using the effect of induction includes a teleloop cable and a transformer coupled to the teleloop cable. The transformer receives an input signal from a microphone, a playback device, receiver or any other device which may be coupled to the transformer. The transformer carries out a suitable amplification and transformation and outputs the transformed input signal to the teleloop cable. The transformed input signal passing through the teleloop cable generates an electromagnetic field which is sensed by the telecoil or the induction receiver. Thus, the user of the hearing or listening device is provided with the audio signal received from the microphone, playback device, receiver or other device coupled to the teleloop system.

Typical neckloops comprise a teleloop cable with a clasp having a male and a female plug. The male and the female plug are suitable for preventing a strangulation of the person wearing the neckloop by having a retention/release force in the range of 10 to 100N. The plugs are designed for carrying the alternating current and thus the teleloop signal.

DE 196 28 783 refers to a piece of jewelry comprising at least two jewelry strings which are arranged in parallel around the neck of the user. The two strings are connected via two magnets of opposite polarity, wherein each string comprises one magnet.

WO 2006/105786 A1 refers to a locking system for a piece of jewelry comprising a male and female plug. The locking of the male and female plug is achieved by two magnets of opposite polarity comprised in the male and female plug.

WO 2006/052428 A2 refers to a magnetic clasp for a piece of jewelry. A piece of jewelry comprises a male and female plug, wherein the male plug as well as the female plug comprises a first magnetic element with areas of two opposite magnetic poles, respectively, for supporting the coupling and releasing of the piece of jewelry.

Computer company Apple provides notebook computers with a connector called "MagSafe". The MagSafe power connector is held in place magnetically, which prevents damaging itself or the computer (by e.g., pulling the computer of the table or desk), when, for example, someone is tripping over the cord.

U.S. Pat. No. 7,441,917 B1 refers to an illuminated jewelry article having a conductor loop, a magnetically connectable clasp housing a removable battery and a medallion having an internal light emitting diode. When the clasp housing the battery is closed a current can flow through the conductor loop and the light emitting diode and thus the medallion is illuminated.

U.S. Pat. No. 7,257,438 B2 refers to a patient-worn medical monitoring device which is arranged at a lanyard. The lanyard includes electrodes or other sensors for making physiological measurements and connectors for electrically connecting the electrodes to the monitoring device.

It is an object to provide a neckloop for a teleloop hearing device system which prevents accidental strangulations under any condition. It is further an object to provide a neckloop with a strangulation preventing clasp, which is easily assembled by the user, and which is wear resistant.

According to the invention a neckloop is provided comprising a teleloop cable with an insulation layer, where the teleloop cable is electrically or inductively coupled to a transmitter, and where the teleloop cable has a first end and a first magnet at this first end, and a second end and a second magnet at this second end, and wherein the first magnet and the second magnet are forming a releasable clasp of the neckloop, wherein further the first magnet is provided with a first plating and the second magnet is provided with a second plating, and wherein the first plating is in direct contact with the first end and the second plating is in direct contact with the second end.

Thus, the neckloop according to the invention provides a teleloop cable comprising a releasable magnetic clasp, wherein the alternating current is passing directly through the plating of the first and second magnets, when the magnets are in contact with each other so as to form the neckloop around the neck of a user. Therefore, the first and second magnets having platings, respectively, act as the release mechanism and the conductor at the same time.

Further, the inventive neckloop is advantageous as it avoids use of any conductor pins and thus reduces the number of components. The reduction of needed components according to the inventive neckloop means easier manufacturing, assembly and a much smaller release mechanism.

Also, conventional male and female plugs are prone to damages when a sudden and strong force is applied to the clasp. No such damages can happen to the inventive neckloop as no mechanical, but only magnetic force holds the clasp together.

Also, in un-lucky circumstances one part of the release mechanism may be held or trapped, which may lead to an offset pull direction and in a usual male and female plug type release mechanism this may lead to a highly increased break away force, and result in possibly injury to the wearer. With the magnetic release mechanism proposed, an offset pull will not increase the release force. Thus higher security is offered by the use of the invention.

Further, the inventive neckloop is particularly easy to use as no mechanical male and female parts are to be fitted to each other, but the magnetic force of the first and second magnets assist the, for example elderly, person in positioning the first and second magnets to in a position where the two parts of the clasp attract each other. Also an increased wear resistance is provided, as the magnetic clasp mechanism does not have surfaces which slide along one another and cause abrasion and erosion thereof, which may lead to decrease or even increase of the breake away force or to changes in the electric properties of the electrical conductive path through the clasp.

Preferably, the material of the first and second platings has an electrical conductivity of greater than 10.000.000 S/m. It is further preferred that the material of the first and second platings has an electrical conductivity of greater than 40.000.000 S/m. Also it is preferred that the material of the first and second plating comprises one or more of the following metals: silver, gold or copper. By using a material of the first and second platings with an electrical conductivity of more than 10.000.000 S/m the influence of the clasp interrupting the loop of the teleloop cable can be reduced. A very low contact resistance is achieved by using gold platings which has the positive effect of minimizing the disturbance of the clasp's gap in the teleloop cable. Thus, the magnetic clasp has a very low contact resistance which allows the teleloop signal to be transformed into a signal of higher intensity. Similarly, other highly conductive materials, such as silver and copper may be used for the first and/or second plating.

Preferably, the thickness of the first and/or second plating is between 20 μm and 100 μm. Depending on the electrical conductivity of the material of the first and/or second plating the thickness of the first and/or second plating may be adapted. For example, by using gold as the first and second plating a thickness of 30 μm may be used to allow the alternating current to flow from the first end to the first plating, from the first plating to the second plating and from the second plating to the second end when the clasp is closed. Thus, the costs for manufacturing the inventive neckloop can be modeled by providing different classes of neckloops by using expensive materials, such as gold, with a 30 μm thick plating and by using less expensive materials, having a lower electrical conductivity such as copper with a 40 μm thick plating.

Preferably, the first and/or second magnet is provided with an intermediate material layer between the first and/or second plating and the first and/or second magnet, respectively. By introducing an intermediate material layer between the plating and the magnet a reaction between the materials of the magnet and plating can be avoided. Thus, the durability of the inventive neckloop is enhanced.

Preferably, the material of the intermediate material layer comprises nickel. In order to avoid metal ions of the magnet's material from diffusing into the, e.g. gold, layer and degrading its hardness and non-oxidizing properties an anti-diffusion intermediate material layer such as nickel is used.

Preferably, when the first and second magnets form the clasp, the contact resistance between the first and second ends is between 0.5 mΩ and 5 mΩ. It is further preferred that, when the first and second magnets form the clasp, the contact resistance between the first and second ends is between 0.8 mΩ and 1.5 mΩ. As mentioned above the disturbance of the teleloop signal by interrupting the teleloop cable should be reduced. By providing a contact resistance between 0.5 mΩ and 5 mΩ, particularly between 0.8 mΩ and 1.5 mΩ, the magnetic clasp of the neckloop having a very low contact resistance is achieved allowing the teleloop signal to be transformed into a signal of higher intensity.

Preferably, when the first and second magnets form the clasp, a release force for releasing the first and second magnets from each other is between 5N and 50N. It is further preferred, that, when the first and second magnets form the clasp, a release force for releasing the first and second magnets from each other is between 5N and 25N. By proving a neckloop having a clasp with a release force within these defined ranges a strangulation of the user wearing the neckloop can be safely avoided. Providing a neckloop having a clasp with a release force in that range may be achieved by appropriately selecting the material of the magnets, the size of the magnets, the thickness and material of the plating etc.

Preferably, the first magnet comprises a recess, in which the first end is arranged. It is further preferred that the first end being arranged in the recess is soldered to the fist plating. The same arrangement is preferably provided in the second magnet and for the second end. By providing the magnet with the recess a stable and solid coupling between the end and the magnet can be achieved. By providing not only the outer surface of the magnet, but also the inner surface of the magnet, i.e. within the recess, with the plating the amount of the area of contact between the end and the plating is increased which further contributes to a low contact resistance between the first and second ends. Alternatively, the recess of the magnet may not be provided with the plating but only serve for mechanically coupling the teleloop cable's end and the magnet. In this alternative arrangement the plating is in direct contact with the end outside the recess of the magnet.

Preferably, the neckloop further comprises an insulation layer, in which the teleloop cable and the first and second magnets are arranged. By proving an insulation, for example a plastic over molding, a protection from bending and damages and an improvement of visually appealing of the inventive neckloop is achieved.

Preferably the neckloop has first and second magnets which are partitioned in oppositely polarized pole pairs comprising at least a first and a second pole, and where either the magnets are arranged such that the clasping force is provided by a single pair of oppositely polarized poles of the first and the second magnets respectively, or the magnets are provided such that the clasping force is provided by at least two oppositely polarized poles of each magnet, whereby the magnetic force is provided either transversely to the direction of pull, or the magnetic force is provided in parallel with the direction of pull, when the two magnets of the clasp are pulled apart by a pulling force on the teleloop cable of the neckloop.

By this arrangement of the magnets a particularly simple and reliable magnetic clasp is provided.

In another aspect the invention refers to a neckloop system comprising an inventive neckloop and a transformer element coupled to the neckloop.

Preferably, the transformer element comprises the first or the second magnet. Thus, a further reduction of contact resistance can be achieved by interrupting the teleloop cable in only one location and by not providing two interruptions in the loop of the teleloop cable.

Preferably, the neckloop system further comprises a receiver. A neckloop system comprising a neckloop, a transformer element and a wireless receiver is advantageous as all these components and their characteristics may be adapted to each other at the side of the manufacturer and the user may use the neckloop system without having previous or special knowledge.

Preferably, the transformer element comprises the wireless receiver. By providing a transformer element with an integrated receiver the complexity of the neckloop system may be further decreased which simplifies the usability and wearability of the inventive neckloop system for user.

In another aspect the invention refers to a hearing device system comprising an inventive neckloop and a transformer element, wherein the hearing device system further comprises a hearing device having a telecoil or an induction coil. Such a hearing device system is especially advantageous as all components and their characteristics are adapted to each other thus enhancing the audio signal quality provided to the user and the usability of hearing device system.

In the following, exemplary embodiments of the present invention are further explained referring to the attached drawings, in which FIG. 1 illustrates a user wearing a neckloop system and a hearing or listing device;

Figure 9:
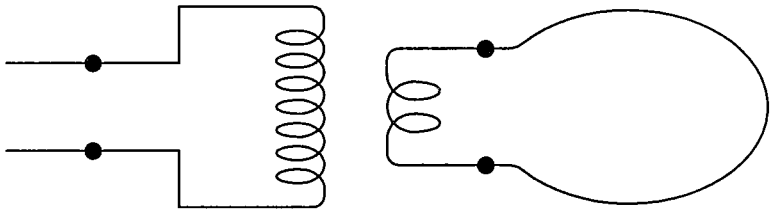
Figure 10:
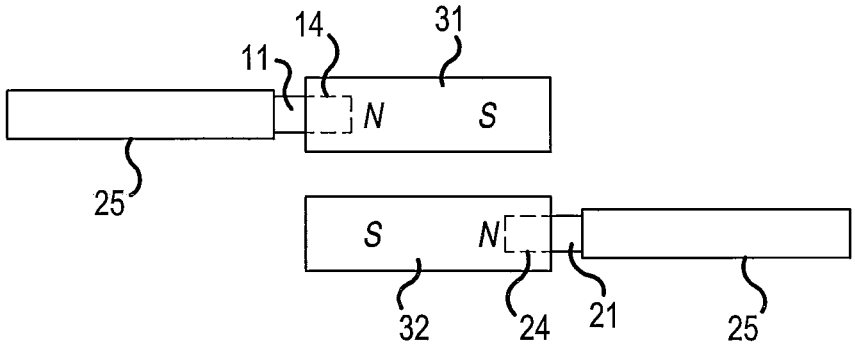
Figure 10A:
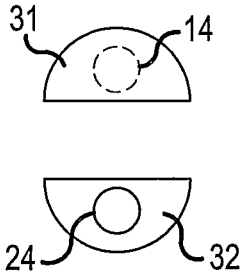
Figure 11:
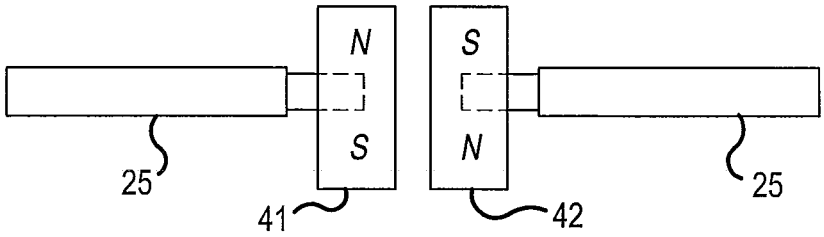
Figure 11A:
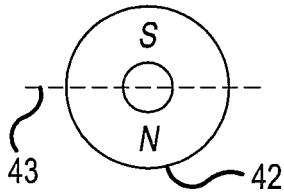

FIG. 9 schematically illustrates the transformer and the teleloop cable of the inventive neckloop;

FIG. 10 schematically illustrates further embodiment with arrangement of magnets;

FIG. 10*a* schematically shows a section through the magnets in FIG. 10;

FIG. 11 schematically illustrates further embodiment with arrangement of magnetic release and FIG. 11*a* shows a section through one of the magnets of FIG. 11.

Figure 1:
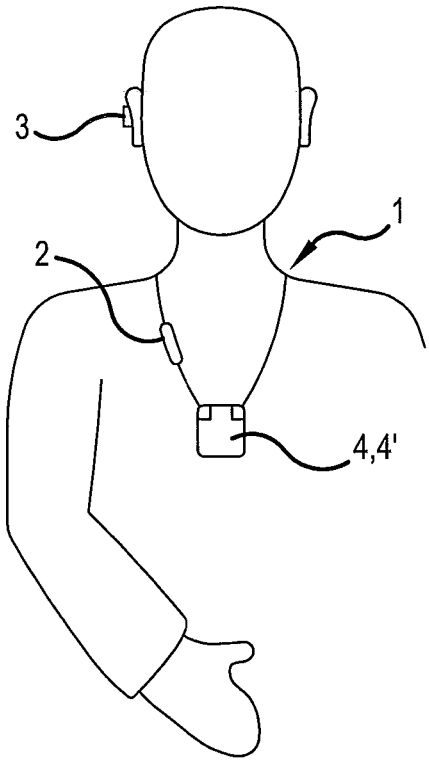

FIG. 1 illustrates a user wearing a neckloop 1 and a hearing (or listening) device 3. The neckloop 1 comprises a magnetic clasp 2 and a transformer element 4, 4'. Transformer element 4 may be provided with a plug for being connected with an external wireless receiver 7. Alternatively, a transformer element 4' may comprise the wireless receiver. The wireless receiver 7 is preferably provided with an FM, Bluetooth or other radio receiver, whereby telephones, wireless microphones or other wireless devices may be coupled to the transformer element 4, 4'. The transformer 4,4' is electrically or inductively coupled to the neckloop cable, and from the transformer 4,4' electric current is caused to flow through the cable in order to generate a magnetic field thereabout, which in turn will generate electric current/voltage in a telecoil of a listening device or hearing aid 3 worn by the user. The current or voltage generated in the teleloop may be processed in the hearing aid and presented as a signal perceivable as sound to the hearing aid user. The signal presented to the user may be in one of the following forms: sound which is served at the eardrum, vibrations served at a skull part, electric signal presented to the cochlear or brain stem or as vibrational input to specific parts of the inner ear. This is all well known in the art.

Figure 2:
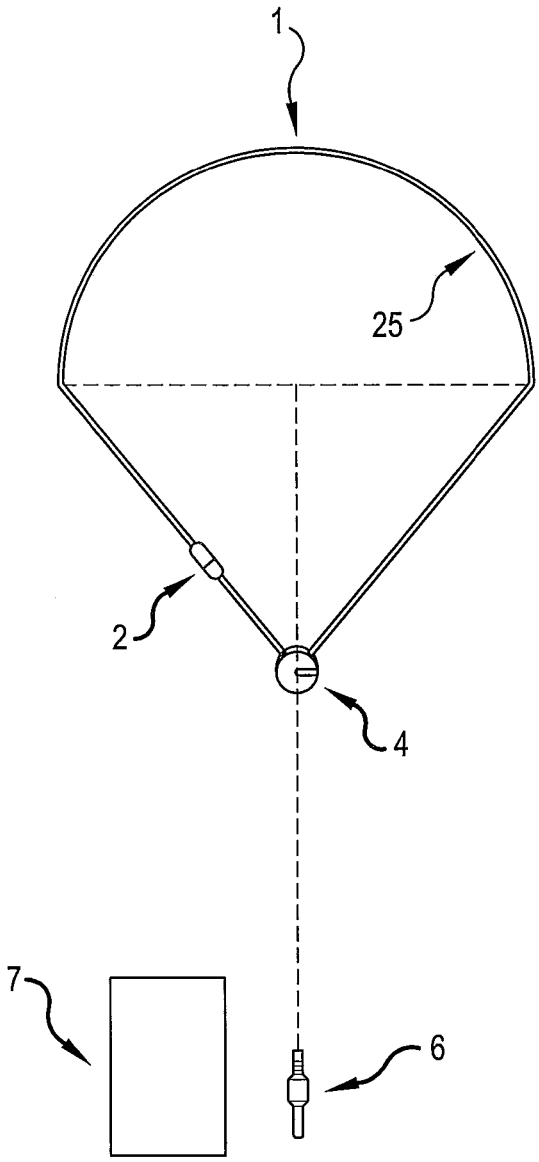
FIG. 2 illustrates an inventive neckloop system.

An exemplary hearing aid system of FIG. 1 is operated as follows. A FM transmitter (not shown) is adapted to pick up an audio signal with its microphone and to transmit it as an audio signal using FM or Bluetooth technology. The transmitter and microphone pair is placed at a remote location, such as next to a TV set or close to a teacher's or family member's voice. The audio signal is transmitted by the FM transmitter to a FM receiver 7 worn by the hearing aid user (c.f. FIG. 2). The FM receiver 7 is adapted to receive the FM signal from the FM transmitter and to transform it into a teleloop signal. This teleloop signal is sent from the FM receiver 7 to the inventive neckloop system through cable connection. Transformer element 4, 4' transforms the teleloop signal up and amplifies it to a signal with the required current density. The amplified teleloop signal is then sent through the teleloop cable 5. The teleloop cable 5 is a cable loop which the hearing aid user wears around his neck. The teleloop cable 5 is provided with the magnetic clasp 2 according to the invention. Hearing aid 3 having a telecoil receives the teleloop signal and transforms it to a signal perceivable as audio as explained.

The magnetic clasp 2 is mounted along the teleloop cable 5 to prevent the wearer from strangulation by the teleloop cable 5 in cases where the cable is trapped during play or other activities. In order to avoid a strangulation of the user the release force, defined as a pull force directly along the teleloop cable 5, is within the range of 5N to 50N, particularly within the range of 5N to 25N.

The teleloop cable 5 has a cross section area of 3 $mm^2$, wherein the area of the cross section is directly linked to the specifications of the transformer element 4, 4' and the length of the teleloop cable 5. These three parameters relate to the quality and the strength of the teleloop signal the neckloop 1 emits to the hearing aid's telecoil. On other neckloop systems these specifications may be different and they might also have another signal transformation technique.

FIG. 2 illustrates another embodiment of the inventive neckloop system. The neckloop system comprises a neckloop 1 and a transformer element 4. The transformer element 4 is coupled to a plug 6 which is adapted to be connected to an external receiver 7. For example, the plug 6 may be the standard 3.5 mm jack plug. The plug 6 is connectable to a microphone, a playback device, a FM receiver etc., i.e. to any device which provides an input signal representing an audio signal to transformer element 4. Transformer element 4 transforms, after reception of the input signal from plug 6, the input signal and feeds it into the teleloop cable 5. The teleloop cable 5 is not shown directly in FIG. 2, but is enclosed in the isolated cable 25. The magnetic clasp 2 is placed along the teleloop cable 5 and thus interrupts the teleloop cable 5 in two parts each having one end.

Figure 3:
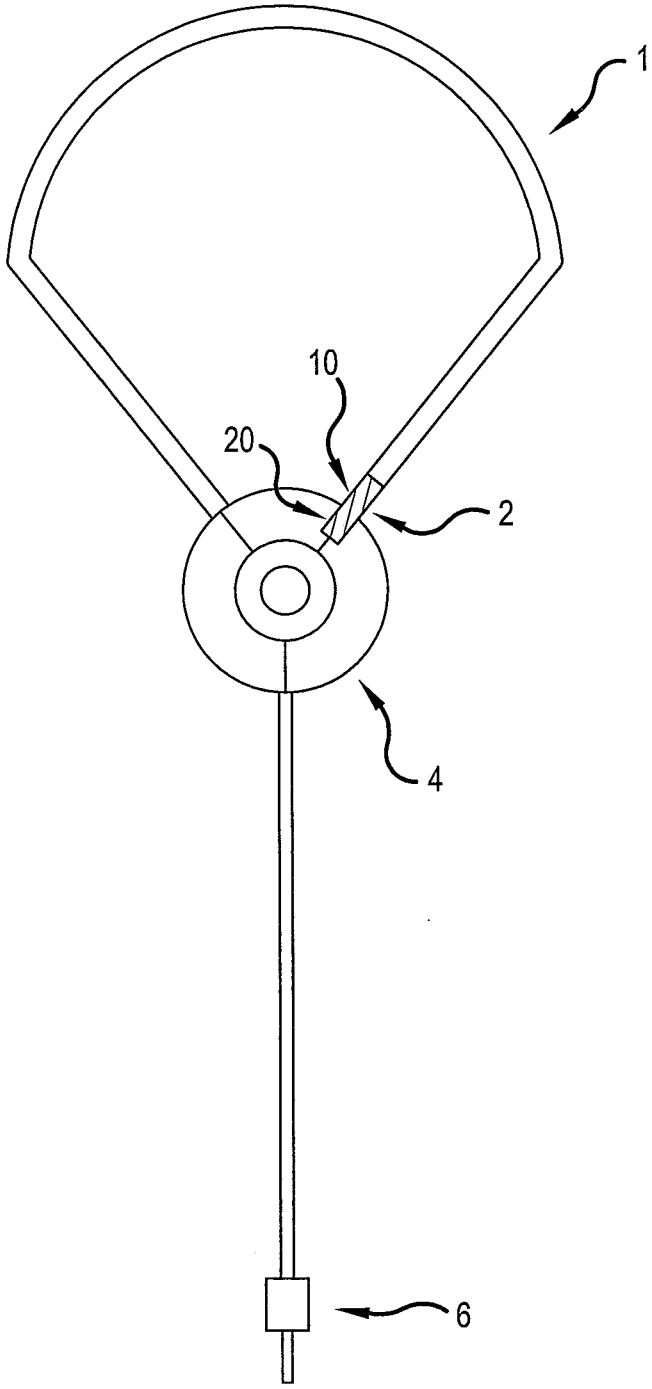
FIG. 3 illustrates a further embodiment of an inventive neckloop system.

FIG. 3 illustrates another embodiment of an inventive neckloop system. Neckloop 1 is coupled to transformer element 4 which is coupled to plug 6. A magnetic clasp 2 is provided to the neckloop 1 as well as to the transformer element 4. That is, one magnet of the magnetic clasp 2 is comprised in the transformer element 4. It is to be noted that in still another embodiment transformer element 4 may be replaced by transformer element 4', that is the transformer element 4' may also comprise the receiver 7. Also, the receiver 7 may be an integrated part of the neckloop 1.

Figure 4:
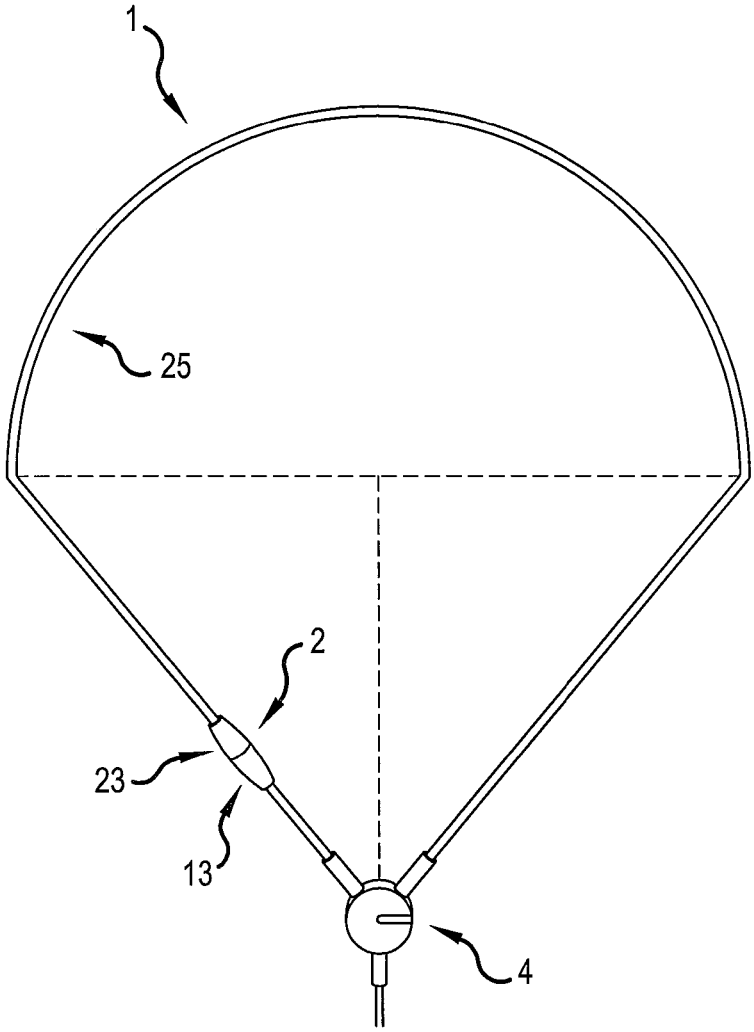
FIG. 4 illustrates an inventive neckloop system with further details.

The structure of the magnetic clasp 2 will be described in the following. FIG. 4 illustrates a neckloop 1, a transformer element 4 and a magnetic clasp 2. The teleloop cable 5 is comprised inside isolation 25. The first and second ends 11, 21 and the first and second magnets 10, 20 are comprised in casings 13 and 23, respectively.

Figure 5:
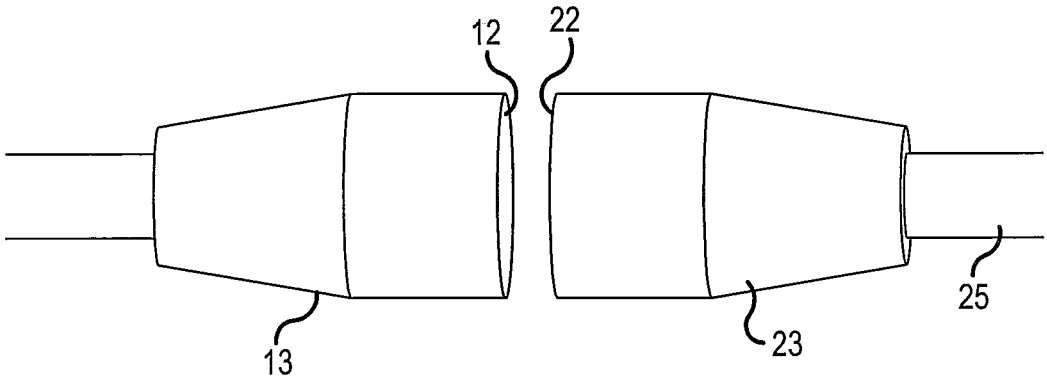
FIG. 5 illustrates the magnetic clasp of the inventive neckloop.

FIG. 5 shows a more detailed view of isolation 25 comprising the teleloop cable 5 and casings 13 and 23 comprising the first and second magnets 10, 20 with platings 12, 22.

Figure 6:
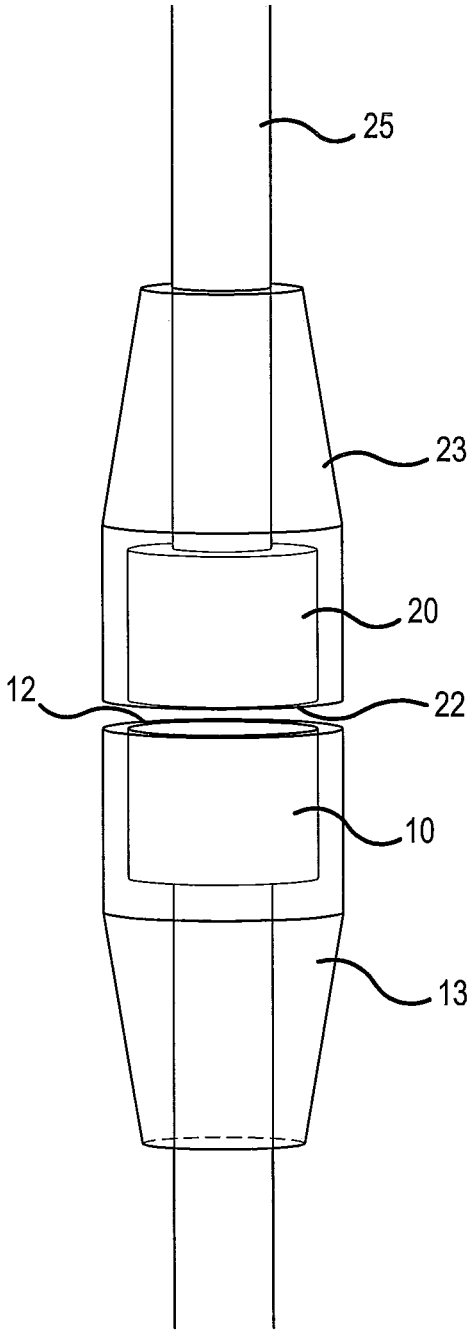
FIG. 6 illustrates the first and second magnets being coupled to the teleloop cable of the inventive neckloop.

In FIG. 6 the casings 13, 23 which are, for example, a plastic over molding, enclosing the magnets 10, 20 and the teleloop cable 5 are made transparent. Within casings 13 and 23 the first and second magnets 10 and 20 are provided. The first magnet 10 is provided with plating 12 and the second magnet 20 is provided with second plating 22.

Figure 7:
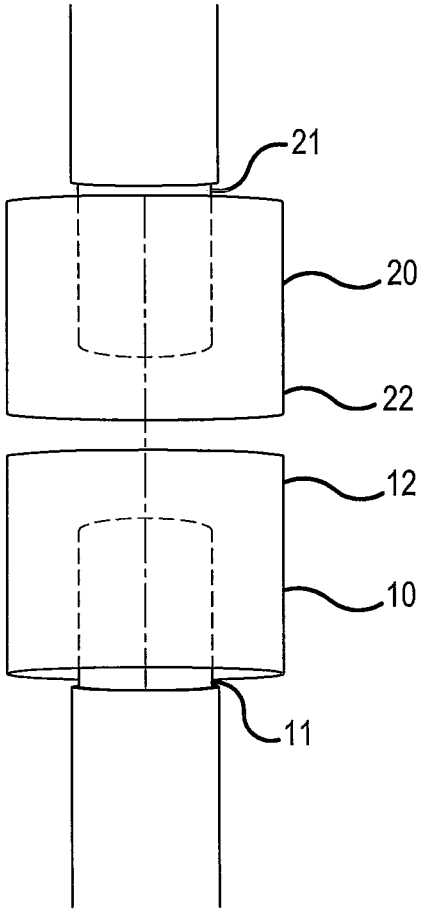
FIG. 7 illustrates the first and second ends being inserted in a recess of the first and second magnets, respectively.
Figure 8A:
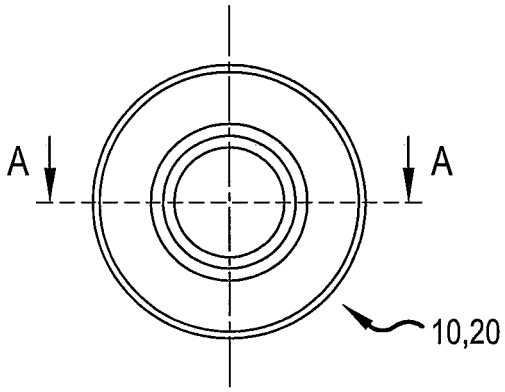
FIG. 8 illustrates a top view (FIG. 8*a*) and a cross section (FIG. 8*b*) of the magnet of the inventive neckloop.
Figure 8B:
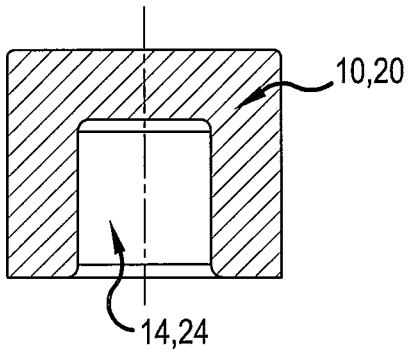

FIG. 7 provides a more detailed view to the coupling of the first and second ends 11, 21 to the platings 12, 22 of the first and second magnets 10, 20 by making the first and second magnets 10, 20 transparent. As also shown in FIGS. 8*a* and 8*b* the first and second magnets 10, 20 are provided with a recess 14, 24 in which the first and second ends 11, 21 are inserted, respectively. The first and second magnets 10, 20 are provided with platings 12, 22 and thus the first and seconds ends 11, 21 are either in contact with the outer plated surface of the first and second magnets 10, 20 or with the outer plated surface as well as with an inner plated surface of the first and second magnets 10, 20. From the above it is clear that the plating on both magnets cover all surfaces thereof also the inside of the recesses 14, 24.

FIG. 9 schematically illustrates the transformer element 4, 4' and the teleloop cable 5 of the inventive neckloop. On the left side of FIG. 9 the transformer is illustrated which receives the FM signal and provides it to the teleloop cable 5 shown on the right side of FIG. 9. The primary winding may have 200 turns with a wire size of 34 AWG (American wire gauge). The teleloop cable 5 being the secondary winding may have 3 turns with 8 strands of 26 AWG. Preferably the primary and secondary windings are provided on one and the same core of a material with high magnetic permeability such as iron. To conserve the energy in the transformer a ringshaped core is preferred.

One example of assembling the inventive neckloop 1 will be described in the following. The first and second magnets 10, 20 are provided with a recess 14, 24, in which the teleloop cable 5 can be inserted. The magnets are provided with a nickel layer. The magnets are then gold plated by electric galvanizing up to a thickness of 30 μm of the gold plating. The teleloop cable 5 is soldered to the magnets' gold plating. By providing recess 14, 24 the soldering is further simplified.

Once the first and second ends 11, 21 of the teleloop cable 5 are arranged and soldered inside the magnets' recess 14, 24 a plastic over molding is made around the first and second magnets 10, 20, and the soldering and joins the insulation 25 of the cable 5. The magnetic clasp 2 is thus protected from bending and damages and made more visually appealing. As magnets are heat sensitive and both soldering and plastic over molding are relative high temperature processes, the first and second magnets 10, 20 may be re-magnetized by the manufacturer after the assembly of magnetic clasp 2.

In the arrangement of the magnets shown in FIG. 10, both the N and S pole of the each magnet will participate in the holding force. This may allow for use of smaller magnets however, further design of the connection between the magnets and the neck-loop will be required to ensure axially aligned pull away force between the two parts when a pulling force is applied. Such a further design is not shown in FIG. 10. As shown, a first magnet 31 has a north pole, marked N connected to the neck loop, and a south pole, marked S at the opposite end thereof. Similarly the second magnet 32 has a north and a south pole at each its end thereof, and here also, the south pole is connected to the neck loop. When the two magnets are placed alongside each other, as shown in FIG. 10, they will clasp together and form a brake away security clasp. As seen in the schematic of FIG. 10*a*, each of the magnets 31, 32 of FIG. 10 may be provided with a semicircular section, such that when clasped together they form a cylindrical body. Recesses 14, 24 are also schematically indicated in FIGS. 10 and 10*a*.

In FIGS. 11 and 11*a* a further embodiment of the invention is schematically shown, whereby the magnets 41, 42 are partitioned in north and south pole along a plane 43 perpendicular to the pulling force provided when pulling the two magnets apart. In FIGS. 11 and 11*a* the magnets are shown with a circular cross section, but also other cross sections would work. In this embodiment the two magnets 41, 42 must be oriented correctly with respect to each other in order to for the clasping together of the two elements to take place. This will not cause any problems for the user as the magnetic clasps will of their own accord have a tendency to orient themselves, if positioned within the reach of the magnetic field of one-another.

In all of the above described embodiments, one of the magnets may be substituted with a ferromagnetic element such as an iron element, which when exposed to a magnetic field will achieve magnetic properties and the exact same function may be achieved therewith.

The invention claimed is:

1. A neckloop, comprising:

a teleloop cable with an insulation layer, the teleloop cable being electrically or inductively coupled to a transmitter, the teleloop cable including a first end;

a first magnet at the first end, the first magnet including a first recess;

a second end; and a second magnet at the second end, the second magnet including a second recess, wherein the first end of the teleloop cable is inserted into the first recess of the first magnet, the second end of the teleloop cable is inserted into the second recess of the second magnet, the first magnet and the second magnet form a releasable clasp of the neckloop, the first magnet is provided with a first plating, the second magnet is provided with a second plating, the first plating is in direct contact with the first end of the teleloop cable, and the second plating is in direct contact with the second end of the teleloop cable.

2. The neckloop of claim 1, wherein the material of the first plating and second plating has an electrical conductivity of more than 10,000,000 S/m.

3. Neckloop of claim 1 or 2, wherein the thickness of the first and/or second plating is between 20 μm and 40 μm.

4. The neckloop of claim 1, further comprising:

an intermediate material layer applied between the first and/or second plating and the first and/or second magnet, respectively.

5. Neckloop of claim 4, wherein the material of the intermediate material layer comprises nickel.

6. The neckloop of claim 1, wherein when the first and second magnets form the clasp, the contact resistance between the first and second ends is between 0.5 mΩ and 5 mΩ.

7. The neckloop of claim 1, wherein when the first and second magnets form the clasp, a release force for releasing the first and second magnets from each other is between 5N and 50N.

8. The neckloop as claimed in claim 1, wherein the first and second magnets are partitioned in oppositely polarized pole pairs comprising at least a first and a second pole, the magnets are arranged such that the clasping force is provided by a single pair of oppositely polarized poles of the first and the second magnets respectively, and the magnetic force is provided either transversely to the direction of pull when the two magnets of the clasp are pulled apart by a pulling force on the teleloop cable of the neckloop.

9. Neckloop system comprising:

a neckloop according to claim 1, and a transformer element coupled to the neckloop.

10. Neckloop system of claim 9, wherein the first or the second magnet is provided at the transformer element.

11. Neckloop system of claim 9 or 10, further comprising a wireless receiver.

12. Neckloop system of claim 11, wherein the wireless receiver is provided at the transformer element.

13. Hearing device system comprising:

a neckloop according to claim 1, and a transformer element coupled to the neckloop, wherein the hearing device system further comprises a hearing device having a telecoil, or an induction receiver.

14. The neckloop as claimed in claim 1, wherein the first and second magnets are partitioned in oppositely polarized pole pairs comprising at least a first and a second pole, the magnets are arranged such that the clasping force is provided by a single pair of oppositely polarized poles of the first and the second magnets respectively, and the magnetic force is provided in parallel with the direction of pull when the two magnets of the clasp are pulled apart by a pulling force on the teleloop cable of the neckloop.

15. The neckloop as claimed in claim 1, wherein the first and second magnets are partitioned in oppositely polarized pole pairs comprising at least a first and a second pole, the magnets are provided such that the clasping force is provided by at least two oppositely polarized poles of each magnet, and the magnetic force is provided in parallel with the direction of pull when the two magnets of the clasp are pulled apart by a pulling force on the teleloop cable of the neckloop.

16. The neckloop as claimed in claim 1, wherein the first and second magnets are partitioned in oppositely polarized pole pairs comprising at least a first and a second pole, the magnets are provided such that the clasping force is provided by at least two oppositely polarized poles of each magnet, and the magnetic force is provided transversely to the direction of pull when the two magnets of the clasp are pulled apart by a pulling force on the teleloop cable of the neckloop.

17. The neckloop as claimed in claim 1, wherein the first plating is provided inside the first recess, and the second plating is provided inside the second recess.

* * * * *